US007183511B2

(12) United States Patent
Ikeda et al.

(10) Patent No.: US 7,183,511 B2
(45) Date of Patent: Feb. 27, 2007

(54) OPERATING BUTTON DEVICE FOR ELEVATOR

(75) Inventors: Kyouichi Ikeda, Tokyo (JP); Kazuhiko Nakao, Chiba-ken (JP); Toshiyuki Yamanouchi, Kanagawa-ken (JP); Kenji Ido, Kanagawa-ken (JP); Takashi Abe, Chiba-ken (JP); Kiyoshi Kobayashi, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/060,528

(22) Filed: Feb. 18, 2005

(65) Prior Publication Data

US 2005/0145469 A1 Jul. 7, 2005

Related U.S. Application Data

(63) Continuation of application No. 10/396,434, filed on Mar. 26, 2003, now abandoned.

(30) Foreign Application Priority Data

Mar. 29, 2002 (JP) ..... 2002-097899
Mar. 10, 2003 (JP) ..... 2003-064026

(51) Int. Cl.
*H01H 9/00* (2006.01)

(52) U.S. Cl. ..... 200/314; 200/312

(58) Field of Classification Search ..... 200/312–317, 200/310, 341
See application file for complete search history.

(56) References Cited

U.S. PATENT DOCUMENTS

| | | | |
|---|---|---|---|
| 4,987,279 | A | 1/1991 | Hirose et al. |
| 5,120,920 | A | 6/1992 | Moriike |
| 5,993,019 | A | 11/1999 | Kline et al. |
| 6,015,224 | A | 1/2000 | Greenstein |
| 6,467,924 | B2 | 10/2002 | Shipman |

FOREIGN PATENT DOCUMENTS

| | | |
|---|---|---|
| DE | 39 23 747 | 1/1991 |
| GB | 2 009 047 | 6/1979 |
| GB | 2 311 748 | 10/1997 |

*Primary Examiner*—Elvin Enad
*Assistant Examiner*—M. Fishman
(74) *Attorney, Agent, or Firm*—Oblon, Spivak, McClelland, Maier & Neustadt, P.C.

(57) ABSTRACT

An operating button device, includes a button top to be operated by a person, and a light emitting element, provided at the rear side of the button top. The button top includes a basement and a tactile symbol provided in the basement, the basement is made of a non-light transmissible synthetic resin material and the tactile symbol is made of a light transmissible synthetic resin material. A ridge tactile character representing the character corresponding to the tactile symbol is formed integrally on the tactile symbol.

19 Claims, 5 Drawing Sheets

OPERATING BUTTON DEVICE FOR ELEVATOR

TECHNICAL FIELD

The present invention relates to an operating button device for an elevator to be operated by a user using an elevator.

BACKGROUND ART

An elevator landing hall has been provided with operating buttons for registration for calling a car, or the like. Moreover, operating buttons for registration of the destination floor, or the like are provided in the car.

FIG. 1 shows a front view of an entrance part of an elevator landing hall. The landing hall is provided with an entrance 1 of the elevator, and the entrance 1 is provided with a hall door 2 to be opened or closed.

An operating panel 3 is provided on the side part wall surface of the entrance 1. The operating panel 3 is provided with various kinds of operating buttons 4 for car calling registration, opening or closing the door, or the like. Moreover, in the car of the elevator, an operating panel is provided on the inner wall surface, with various kinds of operating buttons for destination floor registration, opening or closing the car door, or the like provided in the operating panel.

A structure of a conventional operating button device is shown in FIGS. 2A and 2B. FIG. 2A is a front view of the operating button device, and FIG. 2B is a cross-sectional view thereof.

Reference numeral 10 is a face plate of the operating panel. A frame 13 is mounted on the inner side of the face plate 10 via a stud bolt 11 and a nut 12.

A friction member 14 is provided movably in the inside of the frame 13. A button top 15 is mounted on the friction member 14. The button top 15 is supported so as to be exposed to the front side through an opening 10*a* formed in the face plate 10.

A circuit board 16 is mounted on the frame 13, facing the friction member 14. On the inner surface of the circuit board 16, for example, a tact switch type conductor 17 and a plurality of light emitting elements 18 such as an LED as a light source are provided.

The friction member 14 has a rod 14*a* integrally. The rod 14*a* is interlocked with the conductor 17. According to a spring member in the conductor 17, the button top 15 is forced elastically against the front side of the face plate 10 which is formed integrally with the friction member 14.

The button top 15 and the friction member 14 are made of a synthetic resin material having a light transmissivity such as an acrylic resin. A character film 19 is interposed between the button top 15 and the friction member 14. A predetermined character (including a mark, a graphic, or the like) is printed on the character film 19.

The operating button device shown in FIGS. 2A and 2B is an example for the destination floor registration. A character portion 19*a* (representing "1") showing the destination floor is printed on the character film 19 such that the character "1" is displayed on the surface through the button top 15.

The character portion 19*a* is made of a light transmitting material for allowing the light transmission, and the remaining portion surrounding the same is made of a non-light transmitting material for blocking the light. In contrast, in some cases, the character portion 19*a* is made of the non-light transmitting material and the portion surrounding the same is made of the light transmitting material.

According to the operating button device, a user of the elevator presses the button top 15 with a finger for the destination floor registration operation. Then, the conductor 17 is switched on and the signal thereof is sent to an operating panel so as to register the destination floor. Together with the operation, the light emitting elements 18 are lit so that the character portion 19*a* is illuminated to the surface of the button top 15 by the light for displaying achievement of the destination floor registration.

DISCLOSURE OF INVENTION

An object of the present invention is to provide an operating button device for an elevator, which allows easy recognition and operation of the function content of buttons.

The present invention provides an operating button device for an elevator, comprising a button top to be operated by placing a tip of a finger onto the surface thereof by a user of the elevator, and a light source for illumination, provided on the rear surface side of the button top, wherein the button top includes a basement and a tactile symbol provided in the basement, one of the basement and the tactile symbol is made of a non-light transmissible material and the other is made of a light transmissible material, and a ridge or groove tactile character representing the character corresponding to the tactile symbol is formed on the surface of the tactile symbol, with the line width of the tactile character formed narrower than the line width of the character of the tactile symbol.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

BEST MODE OF CARRYING OUT THE INVENTION

Figure 1:
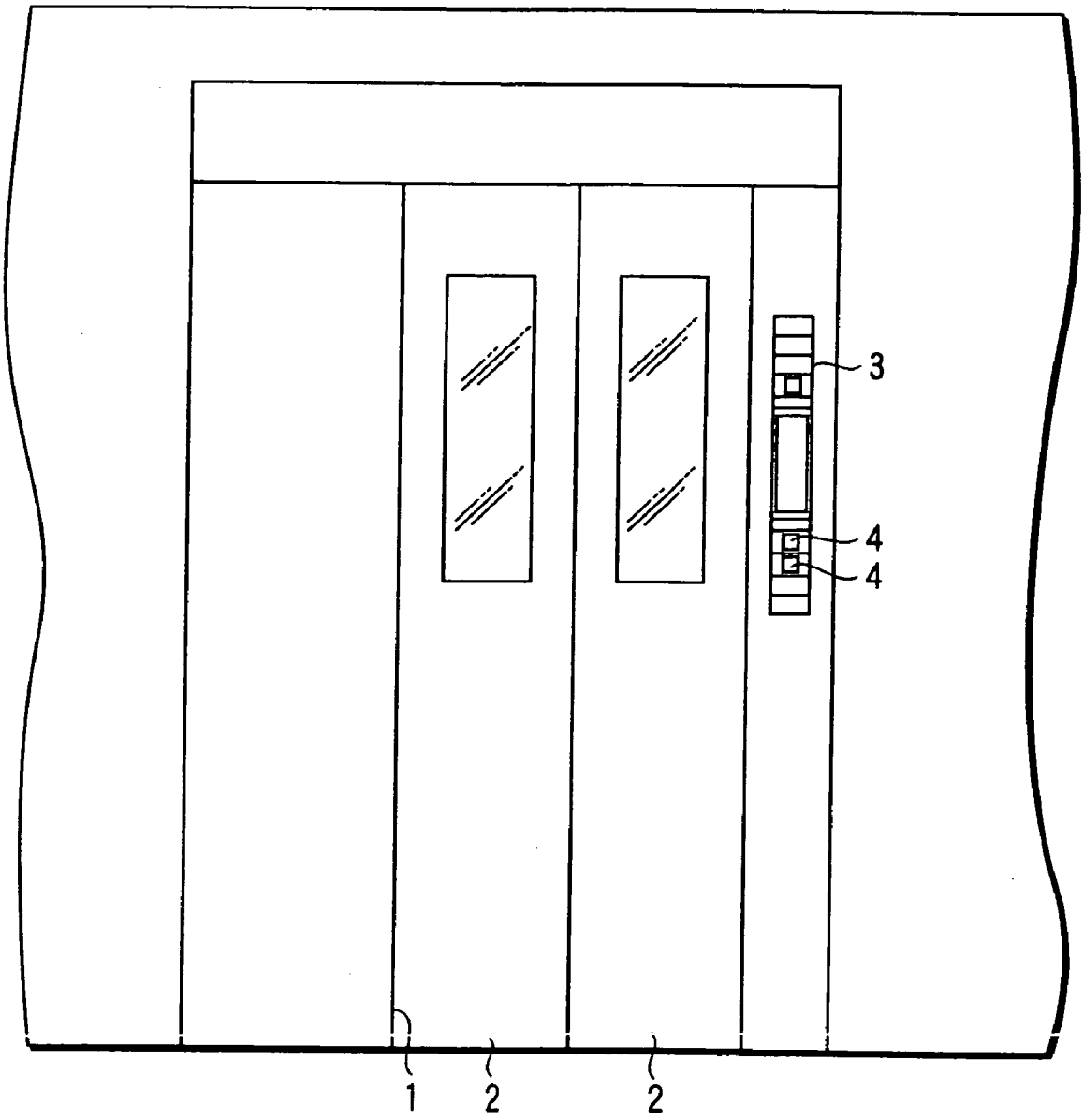
FIG. 1 is a front view of an entrance part of a landing hall of an elevator.
Figure 2A:
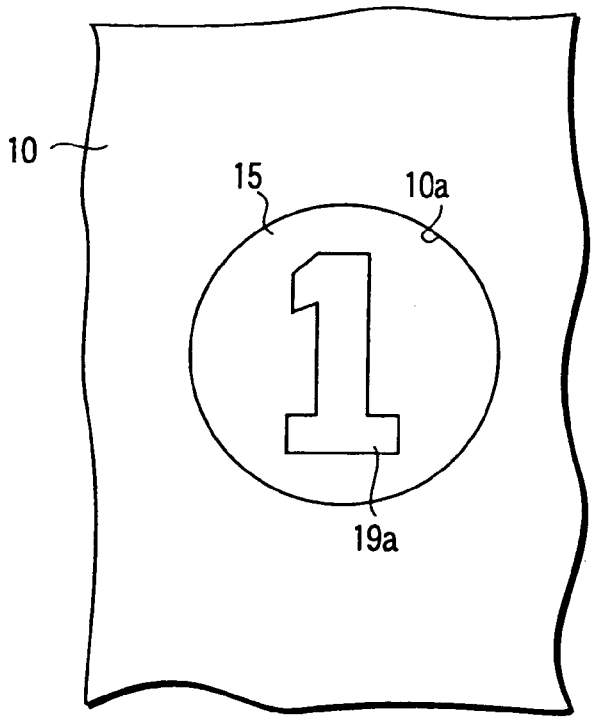
FIG. 2A PRIOR ART
FIG. 2A is a front view of a conventional operating button device.
Figure 2B:
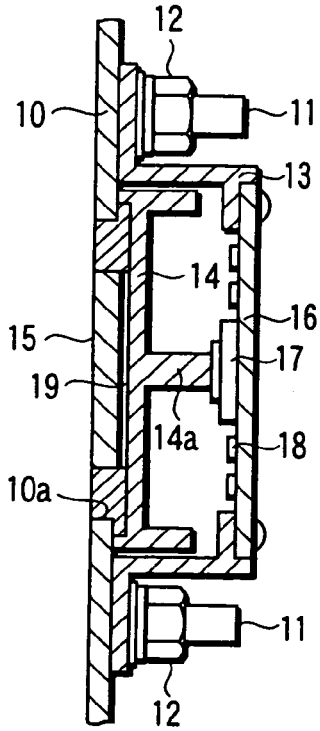
FIG. 2B PRIOR ART
FIG. 2B is a cross-sectional view thereof.

Hereinafter, embodiments of the present invention will be explained with reference to FIGS. 3A to 9B. For the parts corresponding to the conventional configuration shown in FIGS. 2A and 2B, the same numerals are provided without redundant explanation.

Figure 3A:
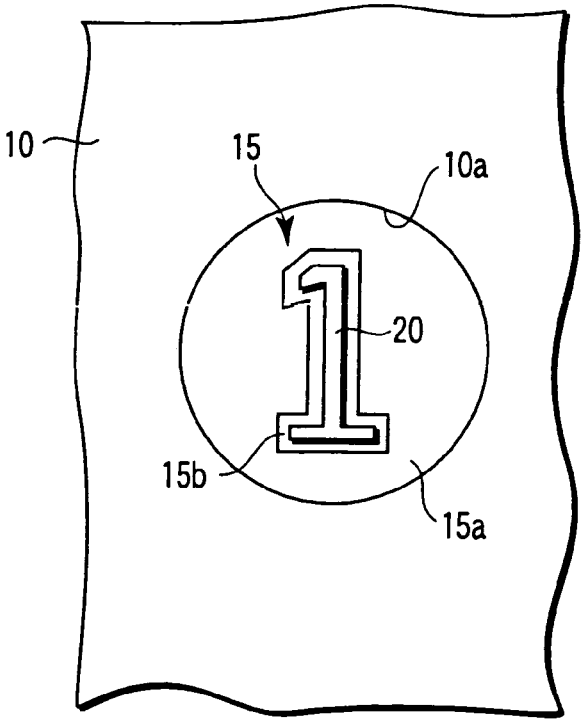
FIG. 3A is a front view of an operating button device according to a first embodiment of the present invention.
Figure 3B:
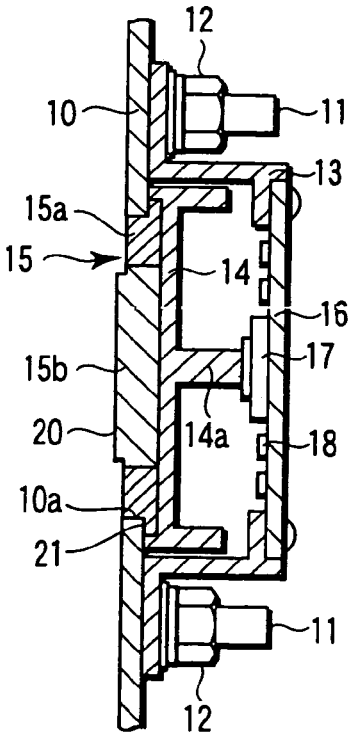
FIG. 3B is a cross-sectional view thereof.

FIGS. 3A and 3B show a first embodiment of the present invention. FIG. 3A is a front view of the operating button device, and FIG. 3B is a cross-sectional view thereof.

The button top 15 of the operating button device comprises a basement 15*a* having a button-like shape, and a tactile symbol 15*b* provided in the central part of the basement 15*a*, comprising a character of, for example, "1", representing the floor of a building.

The basement 15*a* is made of a non-light transmissible synthetic resin material for blocking light. The tactile symbol 15*b* is made of a light transmissible synthetic resin material for transmitting a light, such as an acrylic resin. That is, for example, the basement 15*a* is made of a dark-color synthetic resin material, and the tactile symbol 15*b* is made of a light-color synthetic resin material. According to the color difference, the tactile symbol 15*b* is distinguished visually from the basement 15*a* so as to display the character to the surface.

The tactile symbol 15*b* is substantially flush with the surface of the basement 15*a*. A ridge tactile character 20 as the character corresponding to the tactile symbol 15*b* is formed ridge integrally therewith in an area inside the outline of the tactile symbol 15*b* on the surface of the tactile symbol 15*b*. And a rim of the tactile character 20 is chamfered.

The line width of the character in the tactile symbol 15 is relatively wide, and the line width of the ridge tactile character 20 formed ridge in the area inside the tactile symbol 15*b* is narrower than the line width of the character of the tactile symbol 15*b*. The height of the ridge tactile character 20 is about 1 mm.

The button top 15 is supported according to engagement of a stepped part 21 formed in the circumferential rim of the basement 15*a* with the rim part of the opening 10*a* formed in the face plate 10 so as to be flush with the surface of the face plate 10.

According to the button device, if a user of the elevator presses the button top 15 with a tip of a finger, the friction member 14 is pushed to the inner side of the face plate 10 together with the button top 15. According to the operation, the conductor 17 is switched on so that the signal therefrom is sent to a control panel (not shown) so as to register the operation as well as light the light emitting members 18 on the rear side of the button top 15.

The light of the light emitting members 18 transmits the light transmissible friction member 14 and the tactile symbol 15*b* of the button top 15 so as to be directed for illuminating the character of the tactile symbol 15*b*. From this display, the user can understand that the registration of the operation is achieved.

Since the illuminated character of the tactile symbol 15*b* has a wide line width, a person with a normal sight can clearly recognize the same. Moreover, since the ridge tactile character 20 formed projecting on the surface of the tactile symbol 15*b* is made of the same light transmissible material as that of the tactile symbol 15*b*, it is not visually conspicuous from the tactile symbol 15*b*. Therefore, the character of the tactile symbol 15*b* can be distinguished clearly without being disturbed by the tactile character 20.

In contrast, if a visually handicapped person executes the registration operation, he or she places a tip of a finger on the surface of the button top 15 for touching the ridge tactile character 20 and reading the content thereof by the feeling of the tip of the finger. Since the tactile character 20 has a narrow line width, the character shape can be recognized sharply, and thus the function content can be recognized accurately and quickly. Then, by pushing in the button top 15 according to the recognition result, a predetermined registration operation can be achieved.

According to the operating button device of the first embodiment, both a visually handicapped person and a person with a normal sight can accurately recognize the function content of the buttons so as to comfortably utilize the elevator.

Figure 4A:
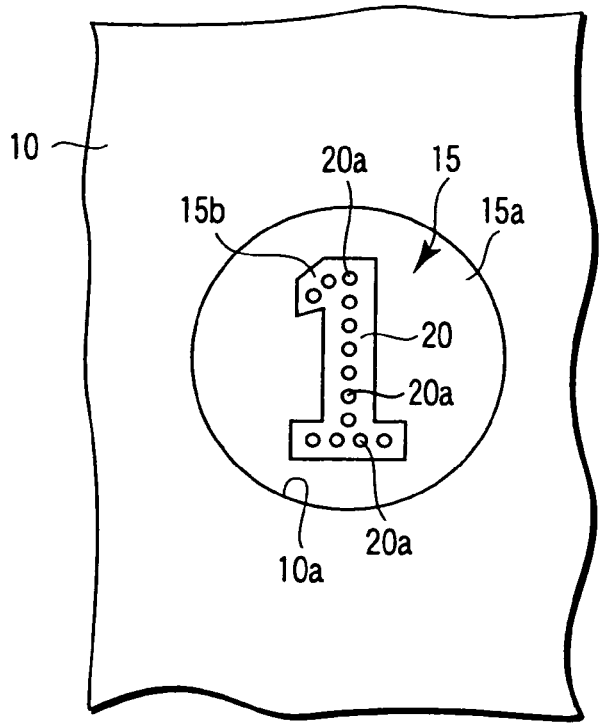
FIG. 4A is a front view of an operating button device according to a second embodiment of the present invention.
Figure 4B:
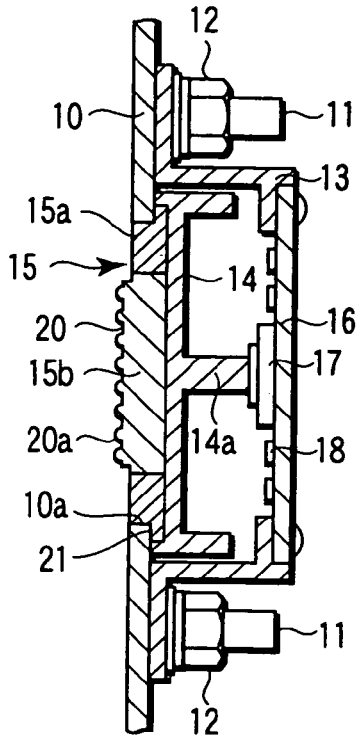
FIG. 4B is a cross-sectional view thereof.

FIGS. 4A and 4B show a second embodiment of the invention. In this embodiment, the tactile character 20 is formed of has a plurality of dot-like projection 20*a*. The height of a plurality of dot-like projections 20*a* is about 1 mm. According to the second embodiment, the same effect as in the first embodiment can be obtained.

Unlike the Braille points for the visually handicapped people, the dot-like projections 20*a* in this case are for directly indicating the form of the characters according to the arrangement of the projections 20*a*. Therefore, also the visually handicapped people who cannot read the Braille points, can read the function content of the button top 15 accurately.

Figure 5A:
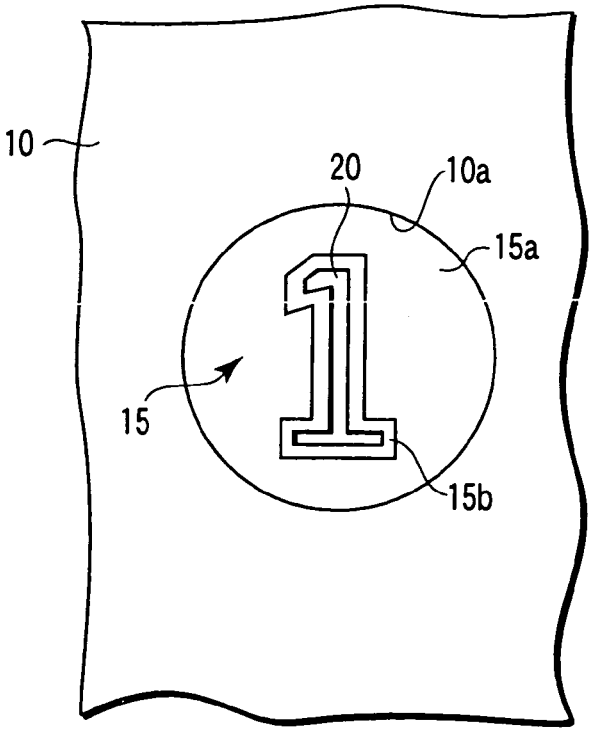
FIG. 5A is a front view of an operating button device according to a third embodiment of the present invention.
Figure 5B:
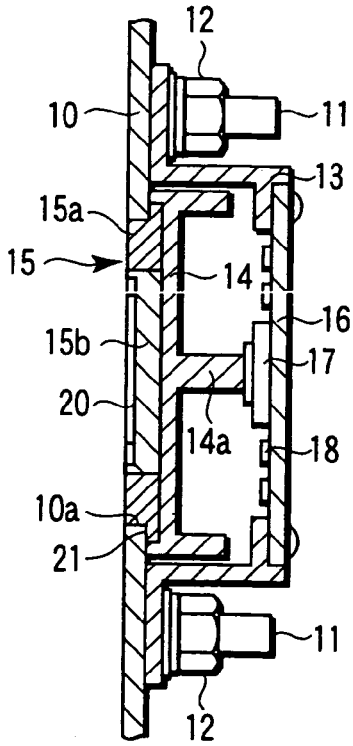
FIG. 5B is a cross-sectional view thereof.

FIGS. 5A and 5B shows a third embodiment of the invention. In this embodiment, the tactile character 20 is formed of a recessed groove formed in the surface of the tactile symbol 15*b*. The line width (grove width) of the tactile character 20 is made narrower than the line width of the character of the tactile symbol 15*b*. The depth of the recessed groove is about 1 mm.

According to the third embodiment, by touching the surface of the button top 15 with the tip of a finger by a visually handicapped person for touching the tactile character 20, the character shape can be recognized sharply so as to read the content thereof accurately and quickly.

Figure 6A:
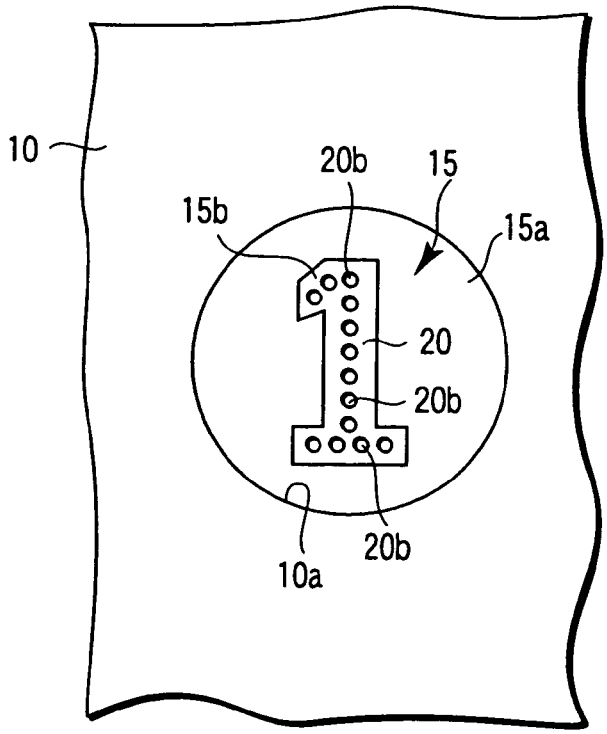
FIG. 6A is a front view of an operating button device according to a fourth embodiment of the present invention.
Figure 6B:
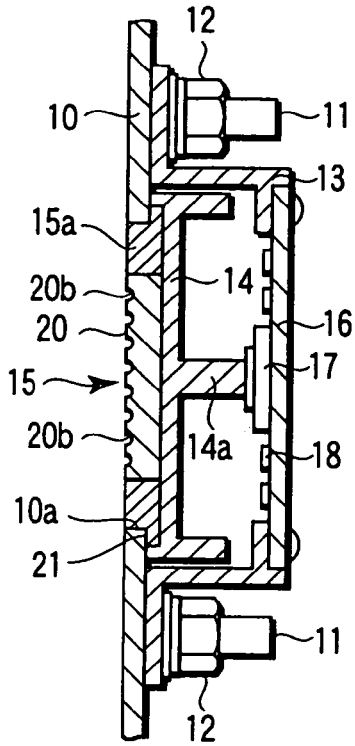
FIG. 6B is a cross-sectional view thereof.

FIGS. 6A and 6B show a fourth embodiment of the invention. In this embodiment, the tactile character 20 is formed of a plurality of dot-like recesses 20*b*. The depth of the recesses 20*b* is about 1 mm. According to the fourth embodiment, the same effect as in the above-mentioned first embodiment can be obtained.

Unlike the Braille points for the visually handicapped people, the dot-like recesses 20*b* in this case are also for directly indicating the form of the characters according to the arrangement of the recesses 20*b*. Therefore, also the visually handicapped people who cannot read the Braille points, can read the function content of the button top 15 accurately.

Figure 7A:
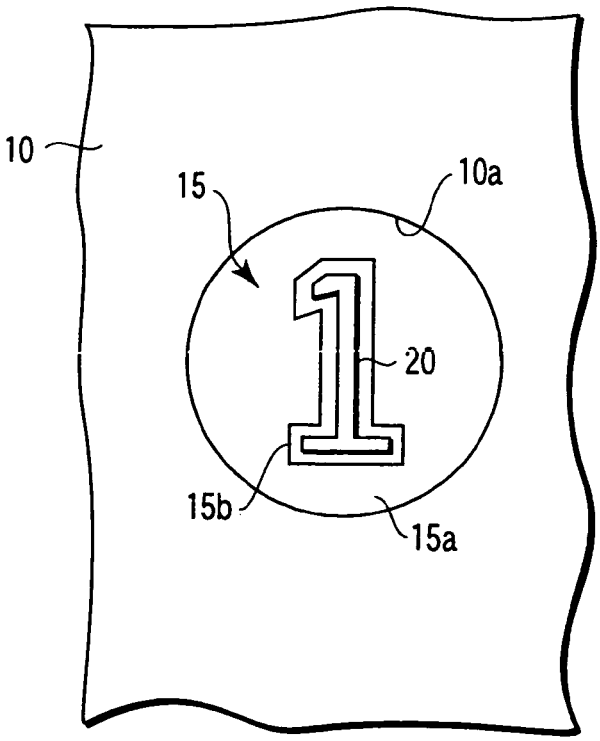
FIG. 7A is a front view of an operating button device according to a fifth embodiment of the present invention.
Figure 7B:
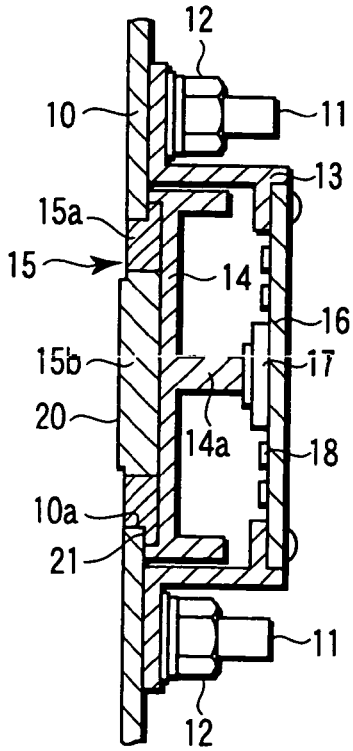
FIG. 7B is a cross-sectional view thereof.

FIGS. 7A and 7B show a fifth embodiment of the invention. Although the basement 15*a* of the button top 15 is made of a non-light transmissible material and the tactile symbol 15*b* is made of a light transmissible material in the above-mentioned first to third embodiments, in contrast, the basement 15*a* of the button top 15 is made of a light transmissible synthetic resin material, and the tactile symbol 15*b* is made of a light non transmissible synthetic resin material in the fifth embodiment.

The tactile character 20 made of the same synthetic resin material as that of the tactile symbol 15*b*, that is, the light non transmissible material is formed projecting integrally on the surface of the tactile symbol 15*b*.

In this embodiment, the basement 15*a* surrounding the tactile symbol 15*b* is illuminated brightly according to the lighting operation of the light emitting elements 18 so that the tactile symbol 15*b* is displayed visually clearly according to the surrounding light.

By touching the surface of the button top 15 with the tip of a finger by a visually handicapped person for touching the tactile character 20, the character shape can be recognized sharply so as to read the content thereof accurately and quickly.

Among the characters used for this kind of operating button device, there are characters to be hardly recognized by the feeling of the tip of a finger. For example, in the case of a numeral "4", in general, a type of the character with the upper end part of the "4" closed is used. However, by recognizing the same by the feeling of the tip of a finger, it may be mixed up with a numeral "9" so as to cause misreading.

Figure 8A:
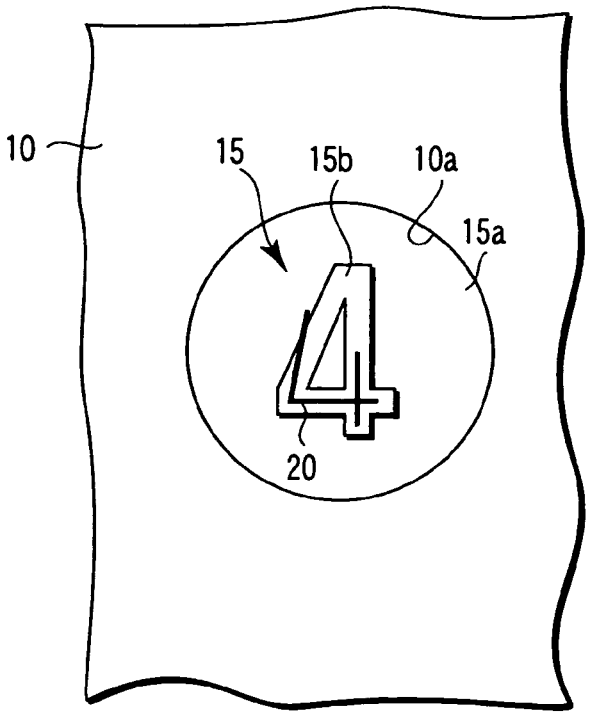
FIG. 8A is a front view of an operating button device according to a sixth embodiment of the present invention.
Figure 8B:
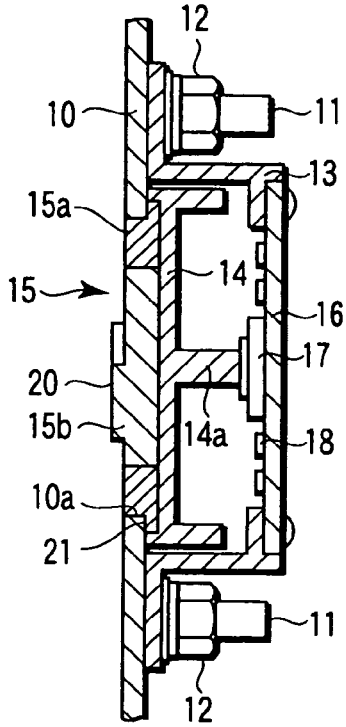
FIG. 8B is a cross-sectional view thereof.

Then, in a sixth embodiment of the invention shown in FIGS. 8A and 8B, a countermeasure therefor is provided. According to this embodiment, the basement 15*a* of the button top 15 is made of a non-light transmissible synthetic resin material, and the tactile symbol 15*b* is made of a light transmissible synthetic resin material.

The character of the tactile symbol 15*b* in this case is for example, a numeral "4", with the tactile character 20 of a projecting narrow line width numeral "4" formed projecting integrally on the surface of the tactile symbol 15*b*.

Although the character of the tactile symbol 15*b* and the tactile character 20 on the surface thereof both represent a numeral "4," they are non-similar figures with different character forms. That is, as shown in FIG. 8A, the character of the tactile symbol 15*b* is a numeral "4" with the upper end part closed, whereas the tactile character 20 is a numeral "4" with the upper end part opened as shown by the black solid line. A part of the upper end side of the tactile character 20 projects from the area of the tactile symbol 15*b* so as to reach to the area of the basement 15*a*.

In this embodiment, the tactile symbol 15*b* is illuminated brightly according to the lighting operation of the light emitting members 18 so as to be displayed clearly to a person with a normal sight.

In contrast, if a visually handicapped person executes a registration operation, he or she places the tip of a finger on the surface of the button for touching the tactile character 20 for reading the content by the feeling of the tip of the finger. Since the numeral "4" as the tactile character 20 has a shape with the upper end part opened, the character content can be read clearly without an error according to the feeling of the tip of a finger without mixing up with an ordinary numeral "9".

Unlike the Braille points for the visually handicapped people, the tactile character 20 is for directly indicating the characters according to the projecting shape thereof. Therefore, also the visually handicapped people who cannot read the Braille points, can read the function content of the button top 15 accurately.

Figure 9A:
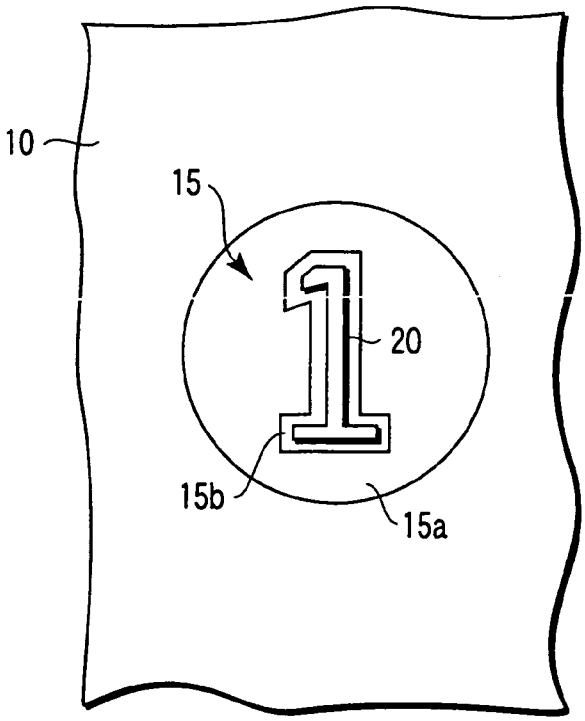
FIG. 9A is a front view of an operating button device according to a seventh embodiment of the present invention.
Figure 9B:
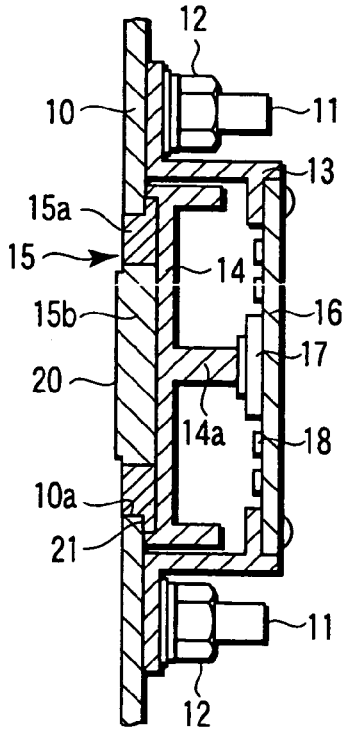
FIG. 9B is a cross-sectional view thereof.

FIGS. 9A and 9B show a seventh embodiment of the invention. In this embodiment, the basement 15*a* and the tactile symbol 15*b* in the button top 15 are both made of a non-light transmissible synthetic resin material, with the synthetic resin material of the basement 15*a* and the synthetic resin material of the tactile symbol 15*b* having different colors so that the character shape of the tactile symbol 15*b* can be recognized visually according to the color difference with respect to the basement 15*a*. The tactile character 20 is formed projecting integrally on the surface of the tactile symbol 15*b*.

According to this embodiment, by touching the tactile character with the tip of a finger by a visually handicapped person, the character shape can be recognized sharply so as to read the content thereof accurately and quickly.

Since the button top 15 is not illuminated, the light emitting elements as the light source are omitted.

The operating button devices can be used not only for an elevator but also for various appliances, for example as a telephone dialing button, or the like.

The present invention can be employed not only in the case of providing as a push-in type operating button device but also in a touch panel type operating button device in the same manner.

Further, as a light source for illuminating the characters, any of a bulb, a fluorescent lamp, an LED (in particular, white color and white color type are preferable), a cold cathode fluorescent lamp, an organic EL (elctroluminescence), or the like can be used. However, an LED and a cold cathode lamp having a long life and the excellent environment resistance are particularly preferable.

Furthermore, the characters to be displayed on the button top, any of characters such as numerals, roman letters and Chinese characters, and marks such as "↑" and "↓" can be used. Further, the button top may have not only a round shape but also a polygonal shape such as a triangular shape and a square shape.

Moreover, the operating button device for an elevator can be used both for the operating button in the car and the operating button of the landing hall.

In addition, the cross-sectional shape of the tactile character may be any shape as long as it has a good touching feeling for a user such as a square shape, a triangular shape and a trapezoidal shape.

The invention claimed is:

1. An operating button device, comprising:

a button top to be operated by a person; and a light source provided at a rear side of the button top, wherein the button top includes:

a basement; and a tactile symbol portion provided in the basement, wherein the basement is made of a non-light transmissible material;

said tactile symbol portion including a tactile symbol and a ridge shaped tactile character corresponding to the tactile symbol formed on a center portion of the tactile symbol portion, with a line width of the tactile character formed narrower than a line width of the tactile symbol; and wherein both the tactile symbol and the ridge shaped tactile character are made of a light transmissible material.

2. The operating button device according to claim 1, wherein the tactile character is formed of a plurality of dot-like projections or recesses.

3. The operating button device according to claim 1 or 2, wherein the tactile character formed on the tactile symbol portion has a non-similar figure with respect to a figure of the tactile symbol.

4. An operating button device, comprising a button top to be operated by a person, wherein the button top includes:

a basement; and a tactile symbol portion provided in the basement, wherein the basement is made of a non-light transmissible material;

said tactile symbol portion including a tactile symbol and a ridge shaped tactile character corresponding to the tactile symbol formed on a center portion of the tactile symbol portion, with a line width of the tactile character formed narrower than a line width of the tactile symbol; and wherein both the tactile symbol and the ridge shaped tactile character are made of a light transmissible material.

5. The operating button device according to claim 4, wherein an area of the tactile symbol except the tactile character, and the basement are substantially flush with each other.

6. The operating button device according to claim 4, wherein a height or a depth of the tactile character is about 1 mm.

7. The operating button device according to claim 4, wherein a rim of the tactile character is chamfered.

8. An operating button device, comprising:

a button top to be operated by a person; and a light source, provided at a rear side of the button top, wherein the button top includes:

a basement; and a tactile symbol portion provided in the basement and including a tactile symbol, a ridge shaped character or mark is formed on a center portion of the tactile symbol portion, wherein the ridge shaped character or mark projects beyond or is recessed below an outermost surface of said tactile symbol, and wherein both the tactile symbol and the ridge shaped tactile character are made of a light transmissible material.

9. The operating button device according to claim 8, wherein the ridge shaped character or mark is formed of a plurality of dot-like ridges.

10. The operating button device according to claim 8, wherein the ridge shaped character or mark formed on the tactile symbol has a non-similar figure with respect to a figure of the tactile symbol.

11. The operating button device according to claim 8, wherein an area of the tactile symbol except the ridge shaped character or mark, and the basement are substantially flush with each other.

12. The operating button device according to claim 8, wherein a height or a depth of the character or mark is about 1 mm.

13. The operating button device according to claim 8, wherein a rim of the character or mark is chamfered.

14. The operating button device according to claim 8, wherein a plurality of characters or marks are formed on the button top.

15. The operating button device according to claim 8, wherein the light source emits light beams of a plurality of colors.

16. The operating button device according to claim 8, wherein a line width of the character or mark is narrower than a line width of a character corresponding to a tactile symbol.

17. The operating button device according to claim 1, wherein an area of the tactile symbol except the tactile character, and the basement are substantially flush with each other.

18. The operating button device according to claim 1, wherein a height or a depth of the tactile character is about 1 mm.

19. The operating button device according to claim 1, wherein a rim of the tactile character is chamfered.

* * * * *